US006261689B1

(12) United States Patent
Meraldi et al.

(10) Patent No.: US 6,261,689 B1
(45) Date of Patent: Jul. 17, 2001

(54) CELLULOSE FIBERS WITH IMPROVED ELONGATION AT BREAK, AND METHODS FOR PRODUCING SAME

(75) Inventors: Jean-Paul Meraldi, Zurich; Jean-Claude Aubry, Dubendorf; Vlastimil Cizek, Zurich, all of (CH); Joël Ribiere, Chamalieres; AndrëSchneider, Chatel-Guyon, both of (FR)

(73) Assignee: Michelin Recherche et Technique S.A., Granges-Paccot (CH)

( * ) Notice: Subject to any disclaimer, the term of this patent is extended or adjusted under 35 U.S.C. 154(b) by 0 days.

(21) Appl. No.: 09/544,249

(22) Filed: Apr. 5, 2000

Related U.S. Application Data

(62) Division of application No. 09/011,423, filed as application No. PCT/EP96/03444 on Aug. 5, 1996, now Pat. No. 6,093,490.

(30) Foreign Application Priority Data

Aug. 10, 1995 (FR) ..... 95 09905

(51) Int. Cl.[7] ..... D01F 2/00; D01F 2/24
(52) U.S. Cl. ..... 428/393; 428/364
(58) Field of Search ..... 428/364, 393

(56) References Cited

U.S. PATENT DOCUMENTS

| | | | | |
|---|---|---|---|---|
| 4,370,168 | | 1/1983 | Kamide et al. . | |
| 4,839,113 | | 6/1989 | Villaine et al. . | |
| 5,571,468 | | 11/1996 | Meraldi et al. | 264/187 |
| 5,585,181 | | 12/1996 | Meraldi et al. | 428/393 |
| 5,587,238 | | 12/1996 | Meraldi et al. | 428/364 |
| 6,139,959 | * | 10/2000 | Meraldi et al. | 428/393 |

* cited by examiner

*Primary Examiner*—N. Edwards
(74) *Attorney, Agent, or Firm*—BakerBotts L.L.P.

(57) ABSTRACT

Fiber made of cellulose formate and fiber made of cellulose regenerated from cellulose formate. These fibers exhibit high tenacity and modulus properties, combined with improved values of elongation at break and of energy at break. Their elongation at break, in particular, is greater than 6%.

Methods for producing these fibers. The fiber made of cellulose formate is obtained by spinning a liquid crystal solution of cellulose formate according to the so-called dry-jet-wet spinning method, the coagulation stage and the neutral washing stage which follow both being carried out in acetone. The fiber made of cellulose formate in a highly concentrated aqueous sodium hydroxide solution. The spinning and regeneration methods can be employed in line and continuously.

Reinforcing assemblies based on such fibers. Articles reinforced by such fibers or assemblies, these reinforced articles being in particular tires.

13 Claims, No Drawings

CELLULOSE FIBERS WITH IMPROVED ELONGATION AT BREAK, AND METHODS FOR PRODUCING SAME

This application is a divisional of U.S. patent application Ser. No. 09/011,423, filed Feb. 9, 1998, now U.S. Pat. No. 6,093,490, which is a national stage filing of PCT/EP96/03444, filed Aug. 5, 1996.

The invention relates to fibers made of cellulose derivatives and to fibers made of cellulose regenerated from these derivatives.

"Cellulose derivatives" is here understood to mean, in a known way, the compounds formed, as a result of chemical reactions, by substitution of the hydroxyl groups of cellulose, these derivatives also being known as substitution derivatives. "Regenerated cellulose" is understood to mean a cellulose obtained by a regeneration treatment carried out on a cellulose derivative.

The invention more particularly relates to fibers made of cellulose formate and to fibers made of cellulose regenerated from this formate, and to the methods for producing such fibers.

Fibers made of cellulose formate and fibers made of cellulose regenerated from this formate have been described in particular in International Patent Application WO 85/05115 (PCT/CH85/00065), filed by the Applicant Company, or in the equivalent Patent EP-B-179,822 and U.S. Pat. No. 4,839,113. These documents describe the production of spinning solutions based on cellulose formate by reaction of cellulose with formic acid and phosphoric acid. These solutions are optically anisotropic, that is to say that they exhibit a liquid crystal state. These documents also describe the cellulose formate fibers obtained by spinning these solutions, according to the so-called dry-jet-wet spinning technique, and the cellulose fibers obtained after a regeneration treatment of these formate fibers.

In comparison with conventional cellulose fibers, such as rayon or viscose fibers, or with other conventional non-cellulose fibers, such as nylon or polyester fibers, for example, all spun from optically isotropic liquids, the cellulose fibers of Application WO 85/05115 are characterized by a much more orderly structure, due to the liquid crystal nature of the spinning solutions from which they emerge. They thus exhibit very high mechanical properties in extension, in particular very high tenacity and modulus values, but, on the other hand, are characterized by rather low values of elongation at break, these values being on average between 3% and 4% and not exceeding 4.5%.

However, greater values of elongation at break may be desirable when such fibers are used in certain technical applications, in particular as components for reinforcing a tire, in particular a tire carcass casing.

The first aim of the invention is to provide fibers made of cellulose formate and fibers made of regenerated cellulose which, in comparison with the fibers of Application WO 85/05115, exhibit a significantly improved elongation at break and high properties of energy at break.

The second aim of the invention is to produce the above improvements without decreasing the tenacity of the fibers, which is a major advantage of the invention.

Another aim of the invention is to produce fibers made of regenerated cellulose, from cellulose formate, the resistance to fatigue of which, in particular with respect to tires, is substantially improved in comparison with that of the fibers made of regenerated cellulose of the abovementioned Application WO 85/05115.

The fiber made of cellulose formate of the invention is characterized by the following relationships:

$$Ds \geqq 2;$$

$$Te > 45;$$

$$Mi > 800;$$

$$ELb > 6;$$

$$Eb > 13.5,$$

Ds being the degree of substitution of the cellulose as formate groups (in %), Te being its tenacity in cN/tex, Mi being its initial modulus in cN/tex, ELb being its elongation at break in % and Eb being its energy at break in J/g.

The fiber made of cellulose of the invention, regenerated from cellulose formate, is characterized by the following relationships:

$$0 < D_S < 2;$$

$$T_E > 60;$$

$$M_I > 1000;$$

$$EL_B > 6;$$

$$E_B > 17.5,$$

$D_S$ being the degree of substitution of the cellulose as formate groups (in %), $T_E$ being its tenacity in cN/tex, $M_I$ being its initial modulus in cN/tex, $EL_B$ being its elongation at break in % and $E_B$ being its energy at break in J/g.

The fiber made of cellulose formate and the fiber made of regenerated cellulose above are both obtained by virtue of novel and specific methods which constitute other subjects of the invention.

The spinning method of the invention, in order to obtain the fiber made of cellulose formate of the invention, which consists in spinning a solution of cellulose formate in a solvent based on phosphoric acid, according to the so-called dry-jet-wet spinning method, is characterized in that the stage of coagulation of the fiber and the stage of neutral washing of the coagulated fiber are both carried out in acetone.

The regeneration method of the invention, in order to obtain the fiber made of regenerated cellulose of the invention, which consists in passing a fiber made of cellulose formate into a regenerating medium, in washing it and then in drying it, is characterized in that the regenerating medium is an aqueous sodium hydroxide (NaOH) solution in which the sodium hydroxide concentration, recorded as Cs, is greater than 16% (% by weight).

The invention additionally relates to the following products:

- reinforcing assemblies each containing at least one fiber in accordance with the invention, for example cables, plied yarns or multifilament fibers twisted on themselves, it being possible for such reinforcing assemblies to be, for example, hybrids, that is to say composites, containing components of different natures, optionally not in accordance with the invention;
- articles reinforced by at least one fiber and/or one assembly in accordance with the invention, these articles being, for example, rubber or plastic articles, for example plies, belts, pipes or tires, in particular tire carcass casings.

The invention will easily be understood with the help of the description and the non-limiting examples which follow.

I. MEASUREMENTS AND TESTS USED

I-1. Degree of polymerization

The degree of polymerization is recorded as DP. The DP of cellulose is measured in a known way, this cellulose being in powder form or converted beforehand to powder.

The inherent viscosity (IV) of the dissolved cellulose is first of all determined according to Swiss Standard SNV 195 598 of 1970, but at different concentrations which vary between 0.5 and 0.05 g/dl. The inherent viscosity is defined by the equation:

$$IV=(I/C_{\cdot})\times Ln\ (t_1/t_0)$$

in which $C_{\cdot}$ represents the concentration of dry cellulose, $t_1$ represents the duration of flow of the dilute polymer solution, $t_0$ represents the duration of flow of the pure solvent, in a Ubbelhode-type [sic] viscometer, and Ln represents the Naperian logarithm. The measurements are taken at 20° C.

The intrinsic viscosity [η] is then determined by extrapolation of the inherent viscosity IV to zero concentration.

The weight-average molecular mass $M_W$ is given by the Mark-Houwink relationship:

$$[\eta]=K\times M_W^{\alpha}$$

where the constants K and α are respectively:

$K=5.31\times10^{-4}$; $\alpha=0.78$, these constants corresponding to the solvent system used to determine the inherent viscosity. These values are given by L. Valtasaari in the document Tappi 48, 627 (1965).

The DP is finally calculated according to the formula:

$$DP=(M_W)/162,$$

162 being the molecular mass of the elementary cellulose unit.

When it is a matter of determining the DP of cellulose from cellulose formate in solution, this formate must first of all be isolated and then the cellulose regenerated.

The procedure is then as follows:

the solution is first of all coagulated with water in a dispersing device. After filtration and washing with acetone, a powder is obtained which is subsequently dried in an oven under vacuum at 40° C. for at least 30 minutes. After having isolated the formate, the cellulose is regenerated by treating this formate at reflux with normal sodium hydroxide solution. The cellulose obtained is washed with water and dried and the DP is measured as described above.

I-2. Degree of substitution

The degree of substitution of cellulose as cellulose formate is also known as degree of formylation.

The degree of substitution determined by the method described here gives the percentage of alcohol functional groups in the cellulose which are esterified, that is to say converted to formate groups. This means that a degree of substitution of 100% is obtained if the three alcohol functional groups in the cellulose unit are all esterified, or that a degree of substitution of 30%, for example, is obtained if 0.9 alcohol functional group out of three, on average, is esterified.

The degree of substitution is measured differently depending on whether the characterization is performed on cellulose formate (formate in solution or fibers made of formate) or on fibers made of cellulose regenerated from cellulose formate.

I-2.1. Degree of substitution on cellulose formate:

If the degree of substitution is measured on cellulose formate in solution, this formate is first of all isolated from the solution as indicated above in paragraph I1. If it is measured on fibers made of formate, these fibers are precut into pieces 2 to 3 cm long.

200 mg of cellulose formate thus prepared are weighed out accurately and introduced into a conical flask. 40 ml of water and 2 ml of normal sodium hydroxide solution (1N NaOH) are added. The mixture is heated at 90° C. at reflux for 15 minutes under nitrogen. The cellulose is thus regenerated, the formate groups being reconverted to hydroxyl groups. After cooling, the excess sodium hydroxide is back titrated with a decinormal hydrochloric acid solution (0.1N HCl) and the degree of substitution is thus deduced therefrom.

In the present description, the degree of substitution is recorded as Ds when it is measured on fibers made of cellulose formate.

I-2.2. Degree of substitution on fibers made of regenerated cellulose:

Approximately 400 mg of fiber are cut into pieces 2 to 3 cm along, then weighed accurately and introduced into a 100 ml conical flask containing 50 ml of water. 1 ml of normal sodium hydroxide solution (1N NaOH) is added. The components are mixed at room temperature for 15 minutes. The cellulose is thus regenerated completely by converting, to hydroxyl groups, the final formate groups which had withstood the regeneration carried out, after spinning them, directly on continuous fibers. The excess sodium hydroxide is titrated with a decinormal hydrochloric acid solution (0.1N HCl) and the degree of substitution is thus deduced therefrom.

In the present description, the degree of substitution is recorded as $D_S$ when it is measured on fibers made of regenerated cellulose.

I-3. Optical properties of the solutions

The optical isotropy or anisotropy of the solutions is determined by placing a drop of test solution between the linear crossed polarizer and analyzer of an optical polarization microscope, followed by observing this solution at rest, that is to say in the absence of a dynamic constraint, at room temperature.

In a known way, an optically anisotropic solution is a solution which depolarizes light, that is to say which exhibits, thus placed between linear crossed polarizer and analyzer, light transmission (colored texture). An optically isotropic solution is a solution which, under the same observation conditions, does not exhibit the above depolarization property, the field of the microscope remaining black.

I-4. Mechanical properties of the fibers

"Fibers" is understood here to mean multifilament fibers (also known as "spun yarns") composed, in a known way, of a large number of individual filaments with a small diameter (low yarn count). All the mechanical properties below are measured on fibers which have been subjected to a preconditioning. "Preconditioning" is understood to mean the storage of the fibers for at least 24 hours, before measurement, in a standard atmosphere according to European Standard DIN EN 20139 (temperature of 20±2° C.; hygrometry of 65±2%).

For cellulose fibers, such a preconditioning makes it possible, in a known way, to stabilize their degree of moisture (residual water content) at a natural equilibrium level of less than 15% by weight of dry fiber (approximately 11 to 12%, on average).

The yarn count of the fibers is determined on at least three samples, each corresponding to a length of 50 m, by weighing this length of fiber. The yarn count is given in tex (weight in grams of 1000 m of fiber).

The mechanical properties of the fibers (tenacity, initial modulus, elongation and energy at break) are measured in a known way using a Zwick GmbH & Co (Germany) 1435-type or 1445-type tension machine. The fibers, after having received a slight prior protective twist (helical angle of approximately 6°), are subjected to tension over an initial length of 400 mm at a rate of 200 mm/min (or at a rate of 50 mm/min only when their elongation at break does not exceed 5%). All the results given are an average of 10 measurements.

The tenacity (breaking strength divided by the yarn count) and the initial modulus are indicated in cN/tex (centinewton per tex—reminder: 1 cN/tex equals approximately 0.11 g/den (gram per denier)). The initial modulus is defined as the slope of the linear part of the Force-Elongation curve, which occurs just after the standard 0.5 cN/tex pretension. The elongation at break is indicated as a percentage. The energy at break is given in J/g (joule per gram), that is to say per unit of fiber mass.

II. CONDITIONING FOR IMPLEMENTING THE INVENTION

A description is first of all given in the preparation of the spinning solutions, followed by the spinning of these solutions in order to produce fibers made of cellulose formate. The stage of regeneration of the fibers made of cellulose formate, in order to produce fibers made of regenerated cellulose, is explained in a third paragraph.

II-1. Preparation of the spinning solutions

The cellulose formate solutions are prepared by mixing cellulose, formic acid and phosphoric acid (or a liquid based on phosphoric acid) as indicated, for example, in the above-mentioned Application WO 85/05115.

The cellulose can be provided in different forms, in particular in the form of a powder, prepared, for example, by pulverizing a crude cellulose plate. Its initial water content is preferably less than 10% by weight and its DP between 500 and 1000.

The formic acid is the esterification acid, the phosphoric acid (or the liquid based on phosphoric acid) being the solvent for the cellulose formate, known as "solvent" or alternatively "spinning solvent" in the description below. In general, the phosphoric acid used is orthophosphoric acid ($H_3PO_4$) but it is possible to use other phosphoric acids or a mixture of phosphoric acids. The phosphoric acid can, depending on the situation, be used solid, in the liquid state or else dissolved in the formic acid.

The water content of these two acids is preferably less than 5% by weight; they can be used alone or can optionally contain, in small proportions, other organic and/or inorganic acids, such as acetic acid, sulfuric acid or hydrochloric acid, for example.

In accordance with the description given in the above-mentioned Application WO 85/05115, the cellulose concentration in the solution, recorded as "C" below, can vary to a large extent; concentrations C of between 10% and 30% (% by weight of cellulose, calculated on the basis of a non-esterified cellulose, with respect to the total weight of the solution) are possible, for example, these concentrations being in particular a function of the degree of polymerization of the cellulose. The (formic acid/phosphoric acid) ratio by weight can also be adjusted within a wide range.

During the preparation of the cellulose formate, the use of formic acid and of phosphoric acid makes it possible to obtain both a high degree of substitution as cellulose formate, generally greater than 20%, without excessively decreasing the initial degree of polymerization of the cellulose, and a homogeneous distribution of these formate groups, both in the amorphous regions and in the crystalline regions of the cellulose formate.

The kneading means appropriate for the production of a solution are known to a person skilled in the art: they must be suitable for kneading, correctly mixing, preferably at an adjustable rate, the cellulose and the acids until the solution is obtained. "Solution" is here understood to mean, in a known way, a homogeneous liquid composition in which no solid particle is visible to the naked eye. The kneading can be carried out, for example, in a mixer having Z-shaped mixing arms or in a continuous screw mixer. These kneading means are preferably equipped with a device for discharge under vacuum and with a heating and cooling device which makes it possible to adjust the temperature of the mixer and of its contents, in order, for example, to accelerate the dissolution operations, or to control the temperature of the solution during formation.

By way of example, the following procedure can be used:

Cellulose powder (the moisture content of which is in equilibrium with the surrounding moisture content of the air) is introduced into a jacketed mixer having Z-shaped mixing arms and an extrusion screw. A mixture of orthophosphoric acid (99% crystalline) and of formic acid, for example containing three quarters of orthophosphoric acid per one quarter of formic acid (parts by weight), is subsequently added. The entire contents are mixed for a period of approximately 1 to 2 hours, for example, the temperature of the mixture being maintained between 10 and 20° C., until a solution is obtained.

The spinning solutions thus obtained are ready to be spun; they can be transferred directly, for example via an extrusion screw placed at the outlet of the mixer, to a spinning machine in order to be spun thereon, without prior conversion other than conventional operations, such as degassing or filtration stages, for example.

The spinning solutions used for the implementation of the invention are optically anisotropic solutions. These spinning solutions preferably exhibit at least one of the following characteristics:

- their cellulose concentration is between 15% and 25% (% by weight), calculated on the basis of a non-esterified cellulose;
- their total formic acid concentration (that is to say the formic acid part consumed in the esterification plus the free formic acid part remaining in the final solution) is between 10 and 25% (% by weight);
- their phosphoric acid concentration (or concentration of liquid based on phosphoric acid) is between 50% and 75% (% by weight);
- the degree of substitution of the cellulose as formate groups in the solution is between 25% and 50%, more preferably between 30% and 45%;
- the degree of polymerization of the cellulose, in solution, is between 350 and 600;
- they contain less than 10% water (% by weight).

II-2. Spinning of the solutions

The spinning solutions are spun according to the so-called dry-jet-wet-spinning technique: this technique uses a non-coagulating fluid layer, generally air, placed at the die outlet, between the die and the coagulation means.

At the outlet of the kneading and dissolution means, the spinning solution is transferred to the spinning unit where it feeds a spinning pump. From this spinning pump, the solution is extruded through at least one die, preceded by a filter. On its way to the die, the solution is gradually brought to the desired spinning temperature, generally between 35° C. and 90° C., depending on the nature of the solutions, preferably between 40° C. and 70° C. "Spinning temperature" is thus understood to mean the temperature of the spinning solution at the moment when it is extruded through the die.

Each die can contain a variable number of extrusion capillaries, it being possible for this number to vary, for example, from 50 to 1000. The capillaries are generally cylindrical in shape, it being possible for their diameter to vary, for example, from 50 to 80 $\mu$m (micrometers).

At the die outlet, a liquid extrudate is thus obtained which is composed of a variable number of individual liquid veins. Each individual liquid vein is drawn (see spinning-stretch factor SSF or spinning-draw factor SDF hereinbelow) into a non-coagulating fluid layer, before entering the coagulation region. This non-coagulating fluid layer is generally a layer of gas, preferably of air, the thickness of which can vary from a few mm to several tens of mm (millimeters), for example from 5 mm to 100 mm, depending on the specific spinning conditions; in a known way, thickness of the non-coagulating layer is understood to mean the distance separating the lower face of the die, arranged horizontally, and the inlet of the coagulation region (surface of the coagulating liquid).

After passing through the non-coagulating layer, all the liquid veins thus drawn enter the coagulation region and come into contact with the coagulating medium. Under the action of the latter, they are converted, by precipitation of the cellulose formate and extraction of the spinning solvent, to solid filaments of cellulose formate which thus form a fiber.

The coagulating medium employed is acetone.

The temperature of the coagulating medium, recorded at Tc, is not a critical parameter in the implementation of the invention. By way of example, for spinning solutions containing 22% by weight of cellulose, it has been observed that a variation in temperature Tc throughout the temperature range from −30° C. To 0° C. has virtually no effect on the mechanical properties of the fibers obtained.

A negative temperature Tc, that is to say less than 0° C., will preferably be chosen and, in an even more preferable way, less than −10° C.

A person skilled in the art will know how to adjust the temperature of the coagulating medium, depending on the characteristics of the spun solution and on the targeted mechanical properties, by simple optimization tests. Generally, the temperature Tc will be chosen to be lower as the concentration C of the spinning solution becomes lower.

The degree of spinning solvent in the coagulating medium is preferably stabilized at a level of less than 15%, more preferably still less than 10% (% by weight of coagulating medium).

The coagulation means to be employed are known devices, composed, for example, of baths, pipes and/or chambers, containing the coagulating medium and in which the fiber in the course of formation moves. Use is preferably made of a coagulation bath arranged under the die, at the outlet of the non-coagulating layer. This bath is generally extended at its base by a vertical cylindrical tube, a so-called "spinning tube", into which the coagulated fiber passes and in which the coagulating medium circulates.

The depth of coagulating medium in the coagulation bath, measured from the inlet of the bath to the inlet of the spinning tube, can vary from a few millimeters to a few centimeters, for example, depending on the specific conditions for implementing the invention, in particular depending on the spinning rates used. The coagulation bath can be extended, if necessary, by additional coagulation devices, for example by other baths or chambers, placed at the outlet of the spinning tube, for example after a horizontal return point.

The method of the invention is preferably employed so that at least one of the following characteristics is verified:

a) the degree of residual solvent in the fiber, at the outlet of the coagulation means (recorded as Sr), is less than 100% by weight of dry fiber made of formate;

b) the tensile stress undergone by the fiber, at the outlet of the coagulation means (recorded as $\sigma_c$), is less than 5 cN/tex, and, in an even more preferable way, so that the two characteristics a) and b) above are simultaneously verified.

Thus, according to the above preferred conditions, the fiber is left in contact with the coagulating medium until a significant portion of spinning solvent is extracted from the fiber. Moreover, during this coagulation phase, the emphasis is on maintaining the tensions undergone by the fiber at a moderate level: to monitor this, these tensions will be measured immediately at the outlet of the coagulation means, using appropriate tensiometers.

Generally, if it is desired to favor, above everything else, the properties of elongation at break of the fibers made of formate, the invention will preferably be implemented so that the following two relationships are verified:

$$Sr<50\%;\ \sigma_c>2\ \text{cN/tex}.$$

The degree of residual solvent Sr present in the coagulated fiber made of formate is measured, for example, in the following way: fiber is withdrawn at the outlet of the coagulation means, with its coagulating medium; it is then superficially dried with an absorbent paper, without pressure, so as to remove most of the coagulating medium (acetone) which is contained in the surface layer surrounding the fiber and which itself contains a certain fraction of spinning solvent (phosphoric acid or liquid based on phosphoric acid) already extracted from the fiber; the fiber is subsequently washed completely with water, in a laboratory device, so as to completely extract the phosphoric acid which it contains, and then this phosphoric acid is back titrated with sodium hydroxide; for greater accuracy, the measurement is repeated 5 times and the mean is calculated.

At the outlet of the coagulation means, the fiber is taken up on a drive device, for example on motorized rollers. The rate of the spun product on this drive device is known as the "spinning rate" (or alternatively delivery or take-up rate): it is the rate of progression of the fiber through the spinning plant, once the fiber has been formed. The ratio of the spinning rate to the extrusion rate of the solution through the die defines what is known, in a known way, as the spinning-stretch factor or spinning-draw factor (abbreviated to SSF or SDF), which is, for example, between 2 and 10.

Once coagulated, the fiber must be washed to neutrality. "Neutral washing" is understood to mean any washing operation which makes it possible to extract all or virtually all the spinning solvent from the fiber.

A person skilled in the art was naturally, until now, directed to using water as washing medium: in a well known way, water is indeed the "natural" swelling medium for fibers made of cellulose or of cellulose derivatives (see, for example, U.S. Pat. No. 4,501,886) and consequently the medium capable of offering, a priori, the best washing efficiency.

By way of example, Patents or Patent Applications EP-B-220,642, U.S. Pat. No. 4,926,920 and WO 94/17136, like the abovementioned Application WO 85/05115 (page 72, Examples II-1 et seq.), describe the use of water, at the outlet of the coagulation means, for washing fibers made of cellulose formate.

Nevertheless, such a conventional stage of washing with water does not make it possible to obtain fibers made of cellulose formate in accordance with the invention.

In an entirely surprising way, the Applicant company has found that the acetone employed as washing medium, despite a washing power which is, in a known way, markedly lower than that of water, results in fibers which exhibit, once completed (i.e. washed to neutrality and then dried), very markedly improved properties, first and foremost as regards their elongate at break, when they are compared with the fibers described in Application WO 85/05115.

For the implementation of the method of the invention, the stage of coagulation of the fiber and the state of neutral washing of the coagulated fiber must both be carried out in acetone.

The temperature of the washing acetone is not a critical parameter of the method. However, it is obvious that excessively low temperatures will be avoided, so as to promote the kinetics of washing. Preferably, the temperature of the washing acetone, recorded as TW, will be chosen to be positive (this is understood to mean a temperature equal to or greater than 0° C.) and, in an even more preferable way, greater than +10° C. Advantageously, non-cooled acetone can be used, that is to say acetone at room temperature, the washing operation then preferably being carried out in a controlled atmosphere.

Known washing means, for example consisting of baths containing washing acetone in which the fiber to be washed moves, can be employed. The washing times in acetone can typically vary from a few seconds to a few tens of seconds, depending on the specific conditions for implementation of the invention.

Of course, the washing medium, like the coagulating medium, can both contain constituents other than acetone, without the spirit of the invention being modified, provided that these other constituents are only present in a minor proportion; the total proportion of these other constituents will preferably be less than 15%, more preferably less than 10% (% by total weight of coagulating medium or of washing medium). More particularly, if water is present in the coagulation or washing acetone, its content will preferably be less than 5%.

After washing, the fiber made of cellulose formate is dried by any suitable means, in order to remove the washing acetone. Preferably, the degree of acetone at the outlet of the drying means is adjusted to a degree of less than 1% by weight of dry fiber. The drying operation can be carried out, for example, by continuous progression of the fiber over heating rollers or alternatively by employing, principally or additionally, a technique of blowing preheated nitrogen. Preferably, use is made of a drying temperature of at least 60° C., more preferably of between 60° C. and 90° C.

The method of the invention can be implemented in a very wide range of spinning rates, which can vary from several tens to several hundreds of meters per minute, for example to 400 m/min or 500 m/min, if not more. Advantageously, the spinning rate is at least equal to 100 m/min, more preferably at least equal to 200 m/min.

If it is desired to isolate the fiber made of cellulose formate, that is to say not to immediately regenerate it, in particular in order to monitor its mechanical properties before the regeneration operations, the washing stage will preferably be carried out so that the degree of residual spinning solvent in the completed fiber, i.e. washed and dried, does not exceed 0.1% to 0.2% by weight with respect to the weight of dry fiber.

It is also possible to convey the fiber made of cellulose formate, thus spun, directly to the regeneration means, in line and continuously, with the aim of preparing a fiber made of regenerated cellulose.

II-3. Regeneration of the fibers made of formate

In a known way, a method for the regeneration of a fiber made of cellulose derivative consists in treating this fiber in a regenerating medium so as to remove virtually all the substituent groups (so-called saponification treatment), in washing the thus regenerated fiber and in then drying it, these three operations being in principle carried out continuously on the same treatment line, known as a "regeneration line".

As regards the cellulose formate, the regenerating medium used is generally a weakly concentrated aqueous sodium hydroxide (NaOH) solution containing only a few percent of sodium hydroxide (% by weight), for example from 1 to 3% (see, for example, PCT/AU91/00151).

Weakly concentrated aqueous sodium hydroxide solutions, with a sodium hydroxide concentration not exceeding 5% (% by weight), have also been described in Patents or Patent Applications EP-B-220,642, U.S. Pat. No. 4,926,920, WO 94/17136 and WO 95/20629 for the regeneration of fibers made of cellulose formate. They have been used by the Applicant Company for the regeneration of the fibers made of cellulose formate described in the abovementioned Application WO 85/05115, as for the regeneration of the fibers made of cellulose formate of the present invention; these weakly concentrated solutions prove to be entirely satisfactory in resulting in regeneration proper, that is to say in removing virtually all the substituent formate groups: they make it possible to obtain, without difficulty, regenerated fibers for which the degree of substitution as formate groups is less than 2%.

On attempting to increase the sodium hydroxide concentrations beyond 5%, the Applicant Company has found that the filaments of the fibers made of cellulose formate (whether the latter are or are not in accordance with the invention) underwent partial surface dissolution, as soon as the sodium hydroxide concentration reached and exceed 6% by weight approximately, the regenerating medium then becoming a true solvent for the cellulose formate. Such a dissolution, even partial, is entirely harmful to the mechanical properties of the fiber: presence of stuck filaments, fall in strength of the filaments attacked, difficulties in washing the fiber, and the like.

Such problems of interfering dissolution could furthermore be anticipated, it being known, for example, that cellulose fibers of the viscose type are partially or completely soluble in 10% sodium hydroxide solution (see P. H. Hermans, "Physics and Chemistry of Cellulose Fibers", 1st part, Elsevier, 1949) or alternatively that 5% native cellulose are dissolved in an aqueous solution containing 8 to 10% NaOH (see T. Yamashiki, Journal of Applied Polymer Science, vol. 44, 691–698, 1992).

On account of the different factors above, a person skilled in the art was thus very naturally inclined to use weakly concentrated aqueous sodium hydroxide solutions for the regeneration of fibers made of cellulose formate.

However, on continuing to increase the sodium hydroxide concentration in the regenerating medium well beyond the abovementioned 5 to 6%, the Applicant Company has found, entirely surprisingly, that, beyond a certain concentration threshold, not only the phenomena of interfering dissolution disappeared but also and especially that certain properties of the regenerated fiber were very substantially improved, in particular the elongation at break and the energy at break.

In other words, while a conventional regenerating medium (i.e. with a low concentration of sodium hydroxide) is certainly entirely sufficient to regenerate fibers made of cellulose formate, such a medium does not, however, make it possible to obtain fibers made of regenerated cellulose in accordance with the invention.

The method of the invention, for obtaining a fiber made of regenerated cellulose in accordance with the invention, by regeneration of a fiber made of cellulose formate, is characterized in that the regenerating medium is a highly concentrated aqueous sodium hydroxide solution in which the sodium hydroxide concentration, recorded as Cs, is greater than 16% (% by weight).

Use is preferably made of a concentration Cs of greater than 18% and, even more preferably, a concentration of between 22% and 40%; this is because it has been found that such concentration ranges were, as a general rule, more particularly beneficial to the elongation at break of the regenerated fiber, the optimum concentration area being between 22% and 30%.

For the implementation of the regeneration method of the invention, the starting material is preferably a fiber made of cellulose formate in accordance with the invention having in particular as elongation at break ELb of greater than 6%.

The regeneration line consists, in concrete terms and conventionally, of regeneration means, followed by washing means, themselves followed by drying means. None of these devices is critical for the implementation of the invention and a person skilled in the art will know how to define them without difficulty. The regeneration and washing means can consist in particular of baths, pipes, tanks or chambers in which the regenerating medium or the washing medium circulate [sic]. It is possible, for example, to use chambers each equipped with the two motorized rollers around which the fiber to be treated will be wound, this fiber then being sprayed with the liquid medium employed (regenerating or washing medium).

The residence times in the regeneration means should, of course, be adjusted so as substantially to regenerate the fibers made of formate and thus to verify the following relationship with respect to the final regenerated fiber:

$$0>D_s>2.$$

A person skilled in the art will know how to adjust these residence times, which, depending on the specific conditions for implementation of the invention, can vary, for example, from 1 to 2 seconds up to 1 to 2 tens of seconds.

The washing medium is preferably water. This is because, after the above regeneration operation, the fiber made of cellulose can be washed with its natural swelling medium, that is to say with water, the latter exhibiting the best washing efficiency. The water is used at room temperature or at a higher temperature, if necessary, in order to increase the kinetics of washing. A neutralization agent for the unconsumed sodium hydroxide, for example formic acid, can optionally be added to this washing water.

The drying means can consist, for example, of ventilated tunnel ovens, through which the washed fiber moves, or alternatively of heating rollers on which the fiber is wound. The drying temperature is not critical and can vary within a wide range, in particular from 80° C. to 240° C. or more, as a function of the specific conditions for implementation of the invention, in particular according to the rates of passage on the regeneration line. Use is preferably made of a temperature not exceeding 200° C.

At the outlet of the drying means, the fiber is removed from a receiving bobbin and its degree of residual moisture is monitored. The drying conditions (temperature and duration) will preferably be adjusted so that the degree of residual moisture is between 10% and 15%, more preferably still of the order of 12% to 13%, by weight of dry fiber.

The washing and drying times necessary typically vary from a few seconds to a few tens of seconds, depending on the means employed and the specific conditions for implementation of the invention.

During passage through the regeneration line, excessive tensions will, of course, be avoided in order not to damage the fiber, on the one hand, and not to lose, on the other hand, a significant part of the potential elongation at break offered by the use of the regenerating medium which is concentrated in sodium hydroxide. These tensions are generally difficult to access within the different means employed themselves; they can be monitored and measured at the inlet of these different means, using suitable tensiometers. Thus, if it is desired to favor the elongation at break of the regenerated fiber, the tensile stresses at the inlet of the regeneration means, of the washing means and of the drying means will preferably be chosen to be less than 10 cN/tex, and more preferably still less than 5 cN/tex.

Under actual industrial regeneration conditions, and in particular for high regeneration rates, the lower limits of these tensile stresses generally lie at approximately from 0.1 to 0.5 cN/tex, lower values not being realistic from an industrial viewpoint and even undesirable. In particular, it has been noticed that the mechanical properties of the regenerated fibers could be adjusted to a greater or lesser extent by varying these tensile stresses.

The regeneration rate (recorded as Rr), that is to say the rate of passage of the fiber through the regeneration line, can vary from several tens to several hundreds of meters per minute, for example up to 400 to 500 m/min, or indeed more; advantageously, this rate Rr is at least equal to 100 m/min, more preferably at least equal to 200 m/min.

Finally, the regeneration method of the invention is preferably employed in line and continuously with the spinning method of the invention, so that the entire manufacturing line, from the extrusion of the solution through the die to the drying of the regenerated fiber, is uninterrupted.

III. EXAMPLES OF THE IMPLEMENTATION OF THE INVENTION

The tests described hereinbelow can either be tests in accordance with the invention or tests not in accordance with the invention.

III-1. FIBRES MADE OF CELLULOSE FORMATE

A) Fibers in accordance with the invention (Table 1)

A total of 14 spinning tests are carried out on fibers made of cellulose formate according to the spinning method of the invention and in accordance in particular with the information provided in the above paragraphs II-1 and II-2.

The coagulation stage and the stage of neutral washing of the coagulated fiber are both carried out in acetone.

Table 1 gives both the specific conditions for implementation of the method of the invention and the properties of the fibers obtained.

The abbreviations and the units used in this Table 1 are as follows:

Test No.: number of the test (reference from A-1 to A-14);

N: number of filaments in the fiber;

C: concentration of cellulose in the spinning solution (% by weight);

DP: degree of polymerization of the cellulose in the spinning solution;

Rs: spinning rate (in m/min);

Tc: temperature of the coagulating medium (in ° C.);

Sr: degree of residual solvent in the fiber at the outlet of the coagulation means (% by weight);

$\sigma_c$: tensile stress undergone by the fiber at the outlet of the coagulation means (in cN/tex);

Yc: yarn count of the fiber (in tex);

Te: tenacity of the fiber (in cN/tex);

Mi: initial modulus of the fiber (in cN/tex);

ELb: elongation at break of the fiber (in %);

Eb: energy at break of the fiber (in J/g);

Ds: degree of substitution of the cellulose as formate groups in the fiber (in %).

In carrying out these tests, the following specific conditions are additionally used:

all the spinning solutions are prepared from powdered cellulose (with an initial water content equal to approximately 8% by weight and with a degree of polymerization of between 500 and 600), from formic acid and from orthophosphoric acid (each containing approximately 2.5% by weight of water);

these solutions contain (% by weight) from 16 to 22% cellulose, from 60 to 65% phosphoric acid and from 18 to 19% formic acid (total), the initial (formic acid/phosphoric acid) ratio by weight being equal to approximately 0.30;

these solutions are optionally anisotropic and contain a total of less than 10% water (% by weight);

the degree of substitution of the cellulose in the solutions is between 40 and 45% for the solutions containing 16% by weight of cellulose and between 30 and 40% for the other, more concentrated solutions;

the dies contained 500 or 1000 capillaries of cylindrical shape, with a diameter of 50 or 65 $\mu$m;

the spinning temperatures are between 40 and 50° C.;

the SSF or SDF values are between 2 and 6 between 2 and 4 for tests A-1, A-5 to A-9 and A-14; between 4 and 6 for the other tests);

the non-coagulating fluid layer is composed of a layer of air (thickness varying from 10 to 40 mm depending on the tests);

the degree of phosphoric acid in the coagulating medium is stabilized at a level of less than 10% (% by weight of coagulating medium);

the temperature of the washing acetone (Tw) is always positive, between 15 and 20° C.;

the fiber is dried at 70° C. by passing over heating rollers, supplemented by blowing nitrogen heated to 80° C.; the degree of acetone at the outlet of the drying means is less than 0.5% (% by weight of dry fiber);

the degree of residual phosphoric acid on the completed fiber, i.e. washed and dried, is less than 0.1% (% by weight of dry fiber).

TABLE 1

| TEST No. | N filaments | C % | DP | Rs m/min | Tc ° C. | Sr % | $\sigma_c$ cN/tex | Yc tex | Te cN/tex | Mi cN/tex | ELb % | Eb J/g | Ds % |
|---|---|---|---|---|---|---|---|---|---|---|---|---|---|
| A-1 | 1000 | 16 | 440 | 150 | −30 | 40 | 0.7 | 213 | 53 | 1075 | 6.3 | 15.8 | 39 |
| A-2 | 1000 | 20 | 430 | 150 | −30 | 70 | 2.3 | 215 | 64 | 1405 | 6.4 | 18.7 | 36 |
| A-3 | 1000 | 22 | 430 | 150 | −30 | 20 | 0.8 | 213 | 75 | 1720 | 6.7 | 23.8 | 33 |
| A-4 | 1000 | 20 | 430 | 150 | −30 | 30 | 1.1 | 222 | 74 | 1540 | 7.2 | 24.7 | 37 |
| A-5 | 1000 | 16 | 450 | 55 | −20 | 20 | 1.1 | 218 | 73 | 1565 | 9.2 | 29.5 | 41 |
| A-6 | 1000 | 16 | 440 | 55 | −20 | 20 | 0.8 | 220 | 63 | 1205 | 8.7 | 26.2 | 42 |
| A-7 | 1000 | 16 | 440 | 150 | −30 | 35 | 0.7 | 224 | 48 | 955 | 6.5 | 14.6 | 42 |
| A-9 | 1000 | 16 | 440 | 150 | −30 | 35 | 2.3 | 217 | 57 | 1305 | 6.9 | 18.7 | 40 |
| A-9 | 1000 | 16 | 430 | 55 | −30 | 10 | 9.4 | 213 | 73 | 1760 | 6.4 | 22.2 | 42 |
| A-10 | 500 | 22 | 420 | 150 | −30 | 30 | 1.0 | 115 | 70 | 1305 | 6.5 | 20.4 | 32 |
| A-11 | 500 | 22 | 420 | 150 | −15 | 30 | 1.0 | 117 | 76 | 1365 | 6.9 | 23.0 | 32 |
| A-12 | 500 | 22 | 420 | 150 | −10 | 30 | 1.0 | 118 | 71 | 1330 | 6.8 | 21.3 | 32 |
| A-13 | 500 | 22 | 420 | 150 | 0 | 30 | 1.0 | 122 | 67 | 1375 | 6.6 | 20.3 | 32 |
| A-14 | 500 | 16 | 450 | 150 | −30 | 35 | 4.5 | 112 | 65 | 1295 | 6.5 | 19.6 | 42 |

On reading Table 1, it is noted in particular that, with the exception of test A-13, the temperature Tc of the coagulation acetone is always negative, less than −10° C. in the majority of cases.

The DP of the cellulose in the solution is between 400 and 450, which shows in particular a low depolymerization after solubilization.

In addition, it is found that, for all the tests in Table 1, at least one of the following preferred conditions is verified;

$$SR<100\%;\ \sigma_c<5\ cN/tex,$$

and that these two relationships are simultaneously verified in the majority of cases.

In an even more preferred way, the two following relationships are simultaneously verified:

$$Sr<50\%;\ \sigma_c<2\ cN/tex.$$

Moreover, the spinning rates are high, since they are for the most part equal to 150 m/min.

All the mechanical properties shown in Table 1 are mean values calculated with respect to 10 measurements, with the exception of the yarn count (mean with respect to 3 measurements), the standard deviation with respect to the mean (as % of this mean) generally being between 1 and 2.5%.

On reading Table 1, it is found that all the fibers verify the following relationships:

$$Ds \geqq 2;$$

$$Te>45;$$

$$Mi>800;$$

$$ELb>6;$$

Eb>13.5.

Preferably, for the fibers made of cellulose formate of the invention, the Ds values are between 25 and 50%. It is found that, in these examples, they are all between 30 and 45%: in practice, they are identical to the values of degrees of substitution measured on the corresponding spinning solutions.

Preferably, their elongation at break ELb is greater than 7% (Examples A-4 to A-6), more preferably still greater than 8% (Examples A-5 and A-6).

Moreover, these fibers of Table 1 verify, for the most part, the following preferred relationships:

Te>60; Mi>1200; Eb>20.

More preferably still, at least one of the following relationships is verified:

Te>70; Mi>1500; Er>25.

For all the examples in Table 1, it is additionally found that the following relationship is verified:

Mi<1800.

However, particularly high initial modulus values, for example of between 1800 and 2200 cN/tex, or even more, are also accessible with respect to the fibers made of formate in accordance with the invention, normally to the detriment of the elongation at break, by adjusting the parameters of the spinning method according to the invention. This can be achieved in particular by increasing the tensile stresses on the spinning line, for example at the outlet of the coagulation means, during the washing or alternatively during the drying of the fiber; it has also been observed that the use of relatively high concentrations C, in particular of between 24 and 30%, were [sic] favorable to the production of very high initial moduli and tenacities.

B) Fibers not in accordance with the invention (Table 2)

5 spinning tests (referenced from B-1 to B-5) are carried out on fibers made of cellulose formate according to a spinning method not in accordance with the invention.

The general and specific conditions used for the spinning are the same as those used for the fibers in the above Table 1, apart from one exception: the stage of neutral washing of the coagulated fiber is carried out with water (as in the abovementioned Application WO 85/05115) and not with acetone. This washing water is process water at a temperature in the region of 15° C. Moreover, the fibers contain from 250 to 1000 filaments.

Table 2 gives both the specific conditions for implementation of the method of the invention and the properties of the fibers obtained. The abbreviations and the units used in this Table 2 are the same as for the above Table 1.

It is noted that these fibers in Table 2, spun according to the method taught by the abovementioned Application WO 85/05115, can exhibit entirely advantageous characteristics of tenacity and of initial modulus; in particular, after a conventional regeneration stage according to the prior art (weakly concentrated aqueous NaOH solution), they can be converted to regenerated fibers possessing very high tenacities (110 to 120 cN/tex, or even more) combined with very high initial modulus values (3000 to 3500 cN/tex, or indeed more).

Nevertheless, none of these fibers in Table 2 is in accordance with the invention, the following relationship not being verified:

ELb>6.

III-2. Fibers made of Regenerated Cellulose

A) Fibers in accordance with the invention (Table 3):

A total of 23 regeneration tests are carried out on fibers made of cellulose formate in accordance with the regeneration method of the invention, according to the information provided in the above paragraph II-3.

All these regeneration tests are carried out in line and continuously with the spinning operation, the latter being carried out in accordance with the spinning method of the invention: in particular, the coagulation stage and the stage of neutral washing of the coagulated fiber are both carried out in acetone.

The regenerating medium is an aqueous sodium hydroxide solution, the concentration Cs of which is in all cases greater than 16%.

Table 3 gives both specific conditions for the implementation of the method of the invention and the properties of the fibers obtained.

The abbreviations and the units used in this Table 3 are as follows:

Test No.: number of the test (referenced from C-1 to C-23);

N: number of filaments in the regenerated fiber;

Cs: concentration of sodium hydroxide in the regenerating medium (% by weight);

Rr: rate of regeneration (in m/min);

$Y_C$: yarn count of the fiber (in tex);

$T_E$: tenacity of the fiber (in cN/tex);

$M_I$: initial modulus of the fiber (in cN/tex);

$EL_B$: elongation at break of the fiber (in %);

$E_B$: energy at break of the fiber (in J/g).

In carrying out these tests, the following specific conditions are additionally used:

the starting fibers made of cellulose formate, a sample of which (a few tens of meters) has been systematically removed at the outlet of the spinning means, in order to

TABLE 2

| TEST No. | N filaments | C % | DP | Rs m/min | Tc ° C. | Sr % | $\sigma_c$ cN/tex | Yc tex | Te cN/tex | Mi cN/tex | ELb % | Eb J/g | Ds % |
|---|---|---|---|---|---|---|---|---|---|---|---|---|---|
| B-1 | 500 | 16 | 450 | 200 | −20 | 60 | 0.9 | 110 | 67 | 2050 | 5.2 | 18.9 | 42 |
| B-2 | 1000 | 22 | 420 | 150 | −30 | 25 | 0.8 | 220 | 78 | 2150 | 5.1 | 20.6 | 32 |
| B-3 | 500 | 16 | 450 | 200 | −30 | 60 | 0.5 | 110 | 60 | 1940 | 4.4 | 13.9 | 40 |
| B-4 | 250 | 22 | 450 | 150 | −20 | 120 | 1.0 | 56 | 93 | 2810 | 4.0 | 17.5 | 33 |
| B-5 | 750 | 16 | 420 | 200 | −30 | 60 | 0.9 | 168 | 59 | 1685 | 4.7 | 14.6 | 42 |

monitor their mechanical properties, are all in accordance with the invention; in particular, they all possess an elongation at break of greater than 6%;

the regenerating medium used is at room temperature (approximately 20° C.);

the regeneration, washing and drying means are composed of chambers equipped with motorized rollers on which the fiber to be treated will be wound;

as the regeneration is carried out in line and continuously with the spinning, the rate of regeneration Rr shown in Table 3 (from 55 to 200 m/min) is thus equal to the spinning rate Rs;

washing is carried out with process water at a temperature of approximately 15° C.;

the washed fiber is dried on heating rollers, at different temperatures varying from 80° C. to 240° C., according to the specific scheme below; from 80° C., to 120° C. for tests C-2, C-3, C-5, C-10 and C-17; at 240° C. for test C-11; from 160° C. to 190° C. for the other tests;

the tensile stresses measured at the inlet of the regeneration, washing and drying means are always less than 10 cN/tex, in the majority of cases less than 5 cN/tex, except for tests C-7, C-9 and C-15, where a tension equal to or greater than 5 cN/tex was measured at the inlet of at least one of the above means; these tensile stresses are lower than 2 cN/tex at each inlet of the three means stated above (regeneration, washing and drying) for a large number of tests: C-2 to C-5, C-10 to C-11, C-13 to C-14 and C-16 to C-23;

the residence times in the regeneration means are of the order of 15 s, as in the washing means, whereas they are of the order of 10 s in the drying means;

at the outlet of the drying means, the fibers exhibit a degree of residual moisture of the order of 12% to 13% (% by weight of dry fiber).

TABLE 3

| TEST No. | N filaments | Cs % | Rr m/min | $Y_c$ tex | $T_E$ cN/tex | $M_I$ cN/tex | $EL_B$ % | $E_B$ J/g |
|---|---|---|---|---|---|---|---|---|
| C-1 | 500 | 19 | 150 | 92 | 100 | 2295 | 6.8 | 33.3 |
| C-2 | 500 | 20 | 200 | 91 | 79 | 2020 | 6.7 | 26.5 |
| C-3 | 1000 | 24 | 55 | 186 | 73 | 1615 | 6.2 | 22.0 |
| C-4 | 1000 | 24 | 55 | 183 | 82 | 1775 | 8.4 | 33.9 |
| C-5 | 500 | 30 | 200 | 90 | 81 | 1780 | 7.8 | 30.6 |
| C-6 | 1000 | 30 | 150 | 176 | 85 | 1905 | 7.2 | 29.9 |
| C-7 | 1000 | 30 | 150 | 179 | 104 | 2360 | 7.2 | 36.1 |
| C-9 | 500 | 30 | 150 | 90 | 97 | 2080 | 7.3 | 34.6 |
| C-9 | 500 | 30 | 150 | 90 | 98 | 2170 | 7.0 | 33.4 |
| C-10 | 500 | 30 | 150 | 93 | 83 | 1990 | 7.3 | 30.3 |
| C-11 | 500 | 30 | 150 | 90 | 89 | 2075 | 7.4 | 32.6 |
| C-12 | 500 | 30 | 150 | 98 | 99 | 2335 | 6.9 | 33.7 |
| C-13 | 500 | 30 | 200 | 90 | 81 | 1690 | 7.9 | 30.8 |
| C-14 | 1000 | 30 | 200 | 190 | 73 | 1565 | 7.7 | 26.9 |
| C-15 | 1000 | 30 | 150 | 180 | 82 | 1845 | 7.7 | 33.9 |
| C-16 | 1000 | 30 | 150 | 179 | 97 | 2245 | 7.3 | 34.5 |
| C-17 | 1000 | 40 | 200 | 90 | 81 | 2055 | 6.9 | 28.4 |
| C-18 | 500 | 30 | 200 | 89 | 108 | 2540 | 6.6 | 34.6 |
| C-19 | 500 | 30 | 200 | 136 | 99 | 2276 | 7.2 | 35.0 |
| C-20 | 500 | 30 | 200 | 181 | 90 | 2000 | 7.6 | 33.1 |
| C-21 | 500 | 30 | 200 | 91 | 107 | 2580 | 6.5 | 34.1 |
| C-22 | 500 | 30 | 200 | 85 | 102 | 2450 | 6.8 | 34.3 |
| C-23 | 500 | 30 | 200 | 97 | 87 | 2210 | 6.9 | 30.6 |

A measurement of the degree of substitution, as indicated in paragraph I-2.2, has shown that all the fibers in Table 3 have a $D_S$ value of between 0 and 2%, in the great majority of cases between 0.1 and 1%.

As for the preceding results, all the mechanical properties shown in Table 3 are mean values calculated with respect to 10 measurements, with the exception of the yarn count (mean with respect to 3 measurements), the standard deviation with respect to these different means (as % of the mean) generally being between 1 and 2.5%.

It is found that the regenerated fibers in Table 3 verify all the following relationships:

$T_E>60$;

$M_I>1000$;

$EL_B>6$;

$E_B>17.5$.

Preferably, their elongation at break $EL_B$ is greater than 7% (Examples C-4 to C-11, C-13 to C-16, C-19 and C-20), more preferably still greater than 8% (Example C-4).

The best value of elongation at break ($EL_B$=8.4% for test C-4) has in particular been obtained by spinning and regeneration in line of a solution containing 16% by weight of cellulose for which the DP was equal to approximately 420. The sample of corresponding fiber made of formate, removed at the spinning outlet in order to measure the mechanical properties, showed the following properties:

Ds=40; Te=60; Mi=1290; ELb=8.4; Eb=25.3.

Moreover, the great majority of the fibers in Table 3 verify the following relationships;

$T_E>80$; $M_I>1500$; $E_B>25$, a great number of them verifying at least one of the following relationships:

$T_E>100$; $M_I>2000$; $E_B>30$.

Particularly high tenacities (equal to or greater than 100 cN/tex) are recorded in particular in the case of tests C-1, C-7, C-18, C-21 and C-22, combined with high values of elongation and of energy at break, indeed even with high values of initial modulus, greater than 2400 cN/tex in the case of tests C-18, C-21 and C-22.

For all the examples in Table 3, it is additionally found that the following relationship is verified:

$M_I<2600$.

However, particularly high initial modulus values, for example of between 2600 and 3000 cN/tex, are also accessible with respect to the regenerated fibers in accordance with the invention, normally to the detriment of the elongation at break, by adjusting the parameters of the regeneration method according to the invention. This can be achieved in particular by increasing the tensile stresses on the regeneration line or alternatively by selecting starting fibers (made of cellulose formate) which already exhibit particularly high initial modulus values, for example between 1800 and 2200 cN/tex.

While, for the majority of the examples in Table 3, the filament yarn count (yarn count of the fiber $Y_C$ divided by the number N of filaments) is equal to approximately 1.8 dtex (decitex) (the commonest filament yarn count for cellulose fibers), the latter can vary to a large extent, for example from 1.4 dtex to 4.0 dtex, or indeed more, by adjusting, in a known way, the spinning conditions. By way of example, the regenerated fibers in tests C-19 and C-20 possess, respectively, a filament yarn count of 2.9 dtex and of 3.6 dtex. Generally, an increase in the elongation at break $EL_B$, combined with a decrease in the tenacity $T_E$ and in the initial modulus $M_I$, has been observed when the filament yarn count increases.

B) Fibers not in accordance with the invention (Table 4):

A total of 9 regeneration tests are carried out on fibers made of cellulose formate (referenced from D-1 to D-9) according to a regeneration method not in accordance with the invention.

The regeneration conditions are the same as those used for the fibers in accordance with the invention in the above Table 3, apart from one exception: the regenerating medium is an aqueous sodium hydroxide solution in which the sodium hydroxide concentration Cs is at most equal to 16%.

Table 4 gives both the specific conditions for the implementation of the method of the invention and the properties of the fibers obtained. The abbreviations and the units used in this Table 4 are the same as for the above Table. 3.

TABLE 4

| TEST No. | N filaments | Cs % | Rr m/min | $Y_c$ tex | $T_E$ cN/tex | $M_I$ cN/tex | $EL_B$ % | $E_B$ J/g |
|---|---|---|---|---|---|---|---|---|
| D-1 | 1000 | 1 | 100 | 184 | 85 | 2280 | 5.6 | 23.6 |
| D-2 | 250 | 1.5 | 100 | 46 | 76 | 2600 | 4.8 | 17.9 |
| D-3 | 500 | 3 | 150 | 98 | 84 | 2315 | 5.2 | 21.7 |
| D-4 | 500 | 6 | 150 | 98 | 67 | 1895 | 4.4 | 14.3 |
| D-5 | 5GO | 12 | 150 | 108 | 73 | 1975 | 5.0 | 17.8 |
| D-6 | 500 | 16 | 200 | 93 | 63 | 1750 | 5.9 | 18.6 |
| D-7 | 500 | 1 | 200 | 90 | 103 | 2750 | 5.6 | 29.0 |
| D-8 | 500 | 1.5 | 200 | 85 | 107 | 3050 | 4.8 | 25.3 |
| D-9 | 500 | 1.7 | 200 | 87 | 111 | 2970 | 5.0 | 27.4 |

All the fibers obtained are indeed regenerated, insofar as, after monitoring, the values for degree of substitution $D_S$ are always less than 2%, more specifically between 0.1% and 1.0%.

These fibers in Table 4 can exhibit particularly high characteristics of tenacity and of initial modulus (see in particular D-7 to D-9) but it is found that none of them is in accordance with the invention, the following relationship not being verified:

$$EL_B>6.$$

In Examples D-4 and D-5 (Cs=6% and 12%), a partial dissolution at the surface of the filaments was observed, resulting in the presence of bonded filaments and in a poor general condition of the fiber, resulting in very great difficulties in carrying out a neutral washing. In Example D-6, the same phenomena were encountered but to a lesser extent: this is at the limits of the method of the invention (Cs=16%) and, in particular, an elongation at break very close to 6% is recorded.

A comparison of Examples D-3 and C-12 (Table 3) proves to be quite interesting, insofar as the regeneration operations were carried out on the same fiber made of cellulose formate and, with the exception of the sodium hydroxide concentration in the regenerating medium (3% for test D-3, 30% for test C-12), under specific conditions which are strictly identical.

In fact, it is found that, with respect to a conventional regeneration with a weakly concentrated sodium hydroxide solution (test D-3), the method of the invention (test C-12) made it possible to very substantially improve the values of tenacity (increase of 18%), of elongation at break (increase of 33%) and of energy at break (increase of 55%), without significantly modifying the initial modulus value.

All the fibers in the above Tables 1 to 4, made of cellulose formate or made of regenerated cellulose, whether they are or are not in accordance with the invention, exhibit a typical structure and a typical morphology for products spun from a liquid crystal solution, as described in particular in the original application WO 85/05115.

In particular, when their filaments are studied with an optical microscope or a scanning electron microscope, a morphology is observed such that each filament is composed, at least in part, of layers fitted inside one another surrounding the axis of the filament. In addition, it is found that in each layer, in general, the optical direction and the crystallization direction vary virtually periodically along the axis of the filament. Such a structure or morphology is commonly described in the literature under the name of "banded structure".

C) Other properties of the fibers made of regenerated cellulose in accordance with the invention—Use in tires:

In addition to the improved mechanical properties stated above, the fibers made of regenerated cellulose of the invention exhibit numerous other advantages when they are compared with the fibers described in the abovementioned original application WO 85/05115, on the one hand, and with conventional fibers of the rayon type, on the other hand.

C-1. Comparison with fibers made of regenerated cellulose according to WO 85/05115:

Compared with the fibers described in the original application WO 85/05115, the fibers of the invention in particular exhibit a very substantially improved resistance to fatigue, both in laboratory tests and when the tire is run.

Endurance with respect to compression (laboratory test):

For technical fibers, intended in particular to reinforce tire structures, the resistance to fatigue can be analyzed by subjecting assemblies of these fibers to various known laboratory tests, in particular to the fatigue test known under the name of Disk Fatigue Test (see, for example, U.S. Pat. No. 2,595,069 and ASTM Standard D 885-591, revised 67T).

This test, well known to a person skilled in the art (see, for example, U.S. Pat. No. 4,902,774), consists essentially in incorporating plied yarns of the test fibers, treated with an adhesive beforehand, in rubber blocks and then, after curing, in fatiguing the rubber test specimens thus formed by compression, between two rotating disks, a very large number of cycles (for example, between 100,000 and 1,000,000 cycles). After fatigue, the plied yarns are extracted from the test specimens and their residual breaking strength is compared with the breaking strength of control plied yarns extracted from non-fatigued test specimens.

The fibers of the invention, compared with the fibers of the original application WO 85/05115, systematically show a markedly improved endurance in the Disk Fatigue Test.

By way of example, fibers according to the invention exhibiting a preferred elongation at break of greater than 7% and fibers according to Application WO 85/05115, all having an elongation at break of less than 5%, were assembled in order to form plied yarns (of type "A" and "B", respectively) having the same formula 180×2 (tex) 420/420 (t/m).

In a known way, such a formula means that each plied yarn is composed of two spun yarns (multi-filament fibers), each having a yarn count of 180 tex before twisting, which are first individually twisted at 420 t/m in one direction, during a first stage, and are then both twisted together at 420 t/m in the reverse direction, during a second stage. For such a plied yarn, the helical angle is approximately 27° and the twist coefficient (or alternatively twist factor) K is approximately 215, with:

$$K=\text{Twist of the plied yarn (in t/m)}\times[\text{Yarn count of the plied yarn (in tex)}/1520]^{1/2}.$$

(cellulose relative density: 1.52)

Several plied yarns of the "A" type (according to the invention) and of the "B" type (according to WO 85/05115)

were subjected to the above Disk Fatigue Test (6 hours at 2700 cycles/min, with a maximum degree of compression of the test specimen of approximately 16% in each cycle); the declines in breaking strength which follow were recorded on the plied yarns extracted (given as relative values, with a base of 100 for the maximum decline recorded on a plied yarn of the "B" type):

type "A" plied yarn: 25 to 40;

type "B" plied yarn: 70 to 100.

The resistance to fatigue of the regenerated fibers of the invention is thus markedly improved, by a factor of two to three on average, with respect to the regenerated fibers of the original application WO 85/05115.

Endurance in tires:

The ability of technical fibers to reinforce tires can be analyzed, in a known way, by reinforcing a rubber ply with plied yarns of the test fibers, which have been treated with adhesive beforehand, by incorporating the fabric thus formed in a tire structure, for example in a carcass ply, and by then subjecting the tire, thus reinforced, to a running test.

Such running tests are widely known to a person skilled in the art; they can, for example, be carried out on automatic machines which make it possible to vary a large number of parameters (pressure, load, temperature, and the like) during the running. After running, the plied yarns are extracted from the tested tire and their residual breaking strength is compared with that of control plied yarns extracted from control tires which have not been subjected to running.

It was found that the fibers of the invention, when they are used to reinforce a radial tire carcass, show an endurance which is markedly improved with respect to the fibers according to WO 85/05115. In particular, it has been observed that, where fibers according to the prior art did not show resistance (failure of the plied yarns of the "B" type above), due to particularly severe running conditions, the fibers of the invention (plied yarns of the "A" type above) showed virtually no decline, even after several tens of thousands of kilometers.

C-2. Comparison with conventional fibers of the rayon type:

In addition to their markedly higher elongational mechanical properties, the regenerated fibers of the invention exhibit other entirely advantageous characteristics in comparison with conventional rayon fibers.

Resistance to moisture:

The resistance to moisture of cellulose fibers can be analyzed using various known tests, a simple test consisting, for example, in completely soaking the fibers in a water bath for a predetermined time and in then measuring the breaking strength of the fibers in the wet state, by immediately subjecting them to tension at the outlet of the water bath after having simply drained them dry.

After storing for 24 hours in water at room temperature, is is found that the breaking strength in the wet state for the fibers of the invention represents 80 to 90%, depending on the case, of the nominal breaking strength (i.e. in the dry state, measured as indicated in paragraph I-4). For rayon fibers, it represents no more than approximately 60% of the nominal breaking strength.

The fibers of the invention are thus markedly less sensitive to moisture than conventional rayon fibers; they exhibit a better dimensional stability in a moist environment.

Mechanical properties with respect to plied yarns:

The fibers of the invention can be assembled, as described above, in order to form reinforcing assemblies with high or very high mechanical properties, in particular plied yarns, the construction of which can be adapted to a very large extent according to the envisaged application. It is known, for example, that an increase in the twist, i.e. in the helical angle, generally improves the endurance of the plied yarn, increases its elongation at break, while, however, being harmful to its tenacity and to its extensional modulus.

Even for very high twists, corresponding, for example, to a helical angle of the order of 29–30°, which confer excellent endurance properties on the plied yarns, the fibers of the invention, in the twisted state, possess a tenacity which is still superior to the tenacity of non-twisted rayon fibers.

By way of example, the plied yarns in accordance with the invention, prepared according to known twisting methods from the fibers of the invention, exhibit, when the helical angle of the plied yarn is varied from 20 up to 30 degrees, a tenacity which can vary from 75–80 cN/tex up to 45–50 cN/tex, for example a tenacity of the order of 58–66 cN/tex for a helical angle of 23–24° (K=approximately 180) or of 53–57 cN/tex for a helical angle of 26–27° (K=approximately 215), and an elongation at break which can reach values of approximately 10%, if not more.

Thus, the tenacities of the plied yarns in accordance with the invention, with an equivalent twist (same helical angle), are generally much greater than the tenacities with respect to plied yarns which can be obtained from fibers of the rayon type, the tenacity of which scarcely exceeds, in a known way, 45–50 cN/tex before twisting. It will thus be possible to use a smaller amount of them in articles commonly reinforced by conventional rayon fibers.

Endurance in tires:

For actual running conditions, employed on private vehicles equipped with tires of size 165/70 R 13, it was unexpectedly found that fibers of the invention (despite a markedly more rigid and more crystalline structure, since they result from a liquid crystal phase) displayed throughout the running tests (for example, monitoring every 5000 km from 20,000 to 80,000 km) an endurance identical to that of a conventional rayon fiber, for an identical plied yarn construction.

Extensional moduli:

The fibers of the invention, the primary characteristic of which is an improved elongation at break, have an initial modulus which remains altogether high (for example, 1500 to 2600 cN/tex approximately in Table 3), in all cases very markedly higher than that of conventional rayon fibers (1000 cN/tex approximately, in a known way).

This superiority of the fibers of the invention in terms of modulus, which is, of course, encountered with respect to the reinforcing assemblies of these fibers, can be altogether advantageous for articles commonly reinforced by conventional technical rayon fibers by offering such articles the possibility of an improved dimensional stability: this is because, for the same variation Δ(F) in the load or force "F" which is exerted on an assembly of each type, the assembly in accordance with the invention will undergo a markedly smaller variation Δ(EL) in length or in elongation "EL".

In conclusion, a comparison of the results of the invention with those described in Application WO 85/05115, both for fibers made of cellulose formate and for fibers made of regenerated cellulose, shows that the invention has made it possible not only to very substantially increase the values of elongation at break, which are more than doubled in certain cases, but also to maintain the tenacity values at a very high level, indeed even to improve them in numerous cases.

The advantage of such a result must be particularly emphasized.

The improvement introduced by the invention does not consist of a simple shift toward another optimum in a given

[tenacity-elongation at break] combination, with an energy at break which remains substantially the same (total area under the Force-Elongation stress curve remaining substantially constant); it consists, in fact, of a very substantial improvement in any [tenacity-elongation at break] combination, making it possible, as it were, to "extend" the Force-Elongation curves obtained for the fibers of the original application WO 85/05115 and thus to obtain a very markedly improved energy at break (increased area under the the [sic] Force-Elongation curve).

Of course, the invention is not limited to the examples described above.

Thus, for example, different constituents can optionally be added to the basic constituents described above (cellulose, formic acid, phosphoric acid, acetone and sodium hydroxide), without the spirit of the invention being modified.

Thus, the term "cellulose formate" used in this document covers the cases where the hydroxyl groups of the cellulose are substituted by groups other than formate groups, in addition to the latter, for example ester groups, in particular acetate groups, the degree of substitution of the cellulose as these other groups preferably being less than 10%.

The additional constituents, preferably chemically nonreactive with the basic constituents, can be, for example, plasticizers, sizing agents, dyes or polymers other than cellulose which are optionally capable of being esterified during the preparation of the solution. They can also be various additives which make it possible, for example, to improve the spinnability of the spinning solutions, the use properties of the fibers obtained or the adhesiveness of these fibers to a rubber matrix.

The invention also covers the cases where use is made of a die composed of one or more non-cylindrical capillaries with various shapes, for example of a single capillary in the form of a slit, the term "fiber" used in the description and the claims then having to be understood in a more general sense which can include, in particular, the case of a film made of cellulose formate or of a film made of regenerated cellulose.

What is claimed is:

1. Fiber made of regenerated cellulose, characterized by the following relationships:

$O<D_S<2$;

$T_E>60$;

$M_I>1000$;

$EL_B>6$; and $E_B>17.5$, $D_S$ being the degree of substitution of the cellulose as formate groups (in %), $T_E$ being its tenacity in cN/tex, $M_I$ being its initial modules in cN/tex, $EL_B$ being its elongation at break in % and $E_B$ being its energy at break in J/g.

2. Fiber according to claim 1, characterized by the following relationship:

$EL_B>7$.

3. Fiber according to claim 1, characterized by the following relationship:

$EL_B>8$.

4. Fiber according to claim 1, characterized by the following relationships:

$T_E>80$; $M_I>1500$; $E_B>25$.

5. Fiber according to claim 4, characterized by at least one of the following relationships:

$T_E>100$; $M_I>2000$; $E_B>30$.

6. Fiber according to claim 2, characterized by the following relationships:

$T_E>80$; $M_I>1500$; $E_B>25$.

7. Fiber according to claim 3, characterized by the following relationships:

$T_E>80$; $M_I>1500$; $E_B>25$.

8. Fiber according to claim 6, characterized by at least one of the following relationships:

$T_E>100$; $M_I>2000$; $E_B>30$.

9. Fiber according to claim 7, characterized by at least one of the following relationships:

$T_E>100$; $M_I>2000$; $E_B>30$.

10. Fiber according to claim 5, characterized by the following relationship:

$M_I>2400$.

11. Fiber according to claim 1, characterized by the following relationship:

$D_S$ between 0.1 and 1.

12. Fiber according to claim 1, having a filament yarn count of from 1.4 to 4.0 dtex.

13. Fiber according to claim 1, characterized by the following relationship.

* * * * *

UNITED STATES PATENT AND TRADEMARK OFFICE

CERTIFICATE OF CORRECTION

PATENT NO. : 6,261,689 B1
DATED : July 17, 2001
INVENTOR(S) : Meraldi et al.

It is certified that error appears in the above-identified patent and that said Letters Patent is hereby corrected as shown below:

Title page,
Item [75], Inventor(s), "AndrëSchneider" should read -- André Schneider --

Column 3,
Line 11, "IV=(I/C.)$_x$Ln ($t_1t_0$)" should read -- IV=(I/C.)×Ln ($t_1t_0$) --
Line 16, "Ubbelhode-type" should read -- Ubbelohde-type --; and "[sic]" should be deleted Column 4,
Line 1, "I1" should read -- I-1 --

Column 5,
Line 20, "CONDITIONING" should read -- CONDITIONS --

Column 8,
Line 29, "$\delta_c$ > 2 cN/tex." should read -- $\delta_c$ < 2 cN/tex. --

Column 9,
Line 14, "elongate" should read -- elongation --

Column 10,
Line 67, "phenomena" should read -- phenomenon --

Column 11,
Line 35, "circulate" should read -- circulates --; and "[sic]" should be deleted
Line 44, "0>$D_s$>2." should read -- 0<$D_s$<2. --

Column 12,
Line 50, "FIBRES" should read -- FIBERS --

Column 14,
Table 1, TEST No. A-5, ELb %: "9.2" should read -- 8.2 --

Column 15,
Line 36, "were" should read -- was --; and "[sic]" should be deleted
Table 2, TEST No. B-4, Te cN/tex: "93" should read -- 83 --

UNITED STATES PATENT AND TRADEMARK OFFICE

CERTIFICATE OF CORRECTION

PATENT NO. : 6,261,689 B1
DATED : July 17, 2001
INVENTOR(S) : Meraldi et al.

It is certified that error appears in the above-identified patent and that said Letters Patent is hereby corrected as shown below:

Column 17,
Line 30, "of" should read -- on --
Line 32, "of" (first occurrence) should read -- on --
Line 33, "of" (first occurrence) should read -- on --
Table 3, TEST No. C-1, Cs % "19" should read -- 18 --; TEST No. C-3, $M_I$ cN/tex: "1615" should read -- 1815 --; TEST No. C-19, $M_I$ cN/tex: "2276" should read -- 2270 --; and TEST No. C-23, $EL_B$ %: "6.9" should read -- 6.8 --

Column 19,
Table 4, TEST No. D-5, N filaments: "5GO" should read -- 500 --

Column 21,
Line 54, "is" (first occurrence) should read -- it --

Column 22,
Line 7, "of" (first occurrence) should read -- on --
Line 16, "of" (first occurrence) should read -- on --

Column 23,
Line 10, "the [sic]" should be deleted

Signed and Sealed this

Twenty-third Day of July, 2002

*Attest:*

*Attesting Officer*

JAMES E. ROGAN
*Director of the United States Patent and Trademark Office*